US007605770B2

(12) United States Patent
Kim et al.

(10) Patent No.: US 7,605,770 B2
(45) Date of Patent: Oct. 20, 2009

(54) FLAP ANTENNA AND COMMUNICATIONS SYSTEM

(75) Inventors: Yong U. Kim, Bellflower, CA (US); Alan R. Keith, Yorba Linda, CA (US); Joseph B. Aday, Garden Grove, CA (US)

(73) Assignee: The Boeing Company, Chicago, IL (US)

( * ) Notice: Subject to any disclaimer, the term of this patent is extended or adjusted under 35 U.S.C. 154(b) by 376 days.

(21) Appl. No.: 11/306,169

(22) Filed: Dec. 19, 2005

(65) Prior Publication Data

US 2008/0100523 A1 May 1, 2008

(51) Int. Cl.
*H01Q 13/00* (2006.01)

(52) U.S. Cl. ..... 343/781 P; 343/757; 343/882

(58) Field of Classification Search ..... 343/781 P, 343/781 CA, 781 R, 753, 754, 755, 757, 343/909, 912, 882
See application file for complete search history.

(56) References Cited

U.S. PATENT DOCUMENTS

| | | | | |
|---|---|---|---|---|
| 3,605,105 | A * | 9/1971 | Penzias | 343/839 |
| 3,848,255 | A * | 11/1974 | Migdal | 343/761 |
| 4,771,293 | A * | 9/1988 | Williams et al. | 343/757 |
| 7,138,953 | B2 * | 11/2006 | Walker et al. | 343/781 P |
| 7,213,955 | B1 * | 5/2007 | Ladouceur et al. | 362/557 |
| 7,256,749 | B2 * | 8/2007 | DeSargant et al. | 343/781 CA |
| 2003/0234747 | A1 * | 12/2003 | Lynch | 343/781 CA |
| 2004/0066344 | A1 * | 4/2004 | Amyotte et al. | 343/757 |
| 2006/0114168 | A1 * | 6/2006 | Gottl et al. | 343/797 |

* cited by examiner

*Primary Examiner*—Tho G Phan
(74) *Attorney, Agent, or Firm*—Charles L. Moore; Moore & Van Allen, PLLC

(57) ABSTRACT

A flap antenna may include a radio frequency (RF) feed and a shaped reflector formed in a selected shape to reflect electromagnetic radiation to or from the RF feed. The flap antenna may also include a flap reflector to reflect the electromagnetic radiation to or from the shaped reflector. The flap reflector may be a flat plate or the like.

38 Claims, 6 Drawing Sheets

FLAP ANTENNA AND COMMUNICATIONS SYSTEM

BACKGROUND OF THE INVENTION

The present invention relates to antennas and more particularly to a flap antenna and communications system for use on a mobile platform, such as an aerospace vehicle, terrestrial vehicle, watercraft or the like.

Commercial and military aircraft may use in-flight satellite communications to access services such as television services (DirecTV or the like, radio (XM radio or the like), high-speed Internet, telecommunications and other communications services. DirecTV is a trademark of DirecTV, Inc. in the United States, other countries or both, and XM Radio is a trademark of XM Satellite Radio, Inc. in the United States, other countries or both. A high-gain antenna mounted on the aircraft may continuously track a geo-synchronously-orbiting satellite during flight. Currently, the antenna may be either a phased-array or mechanically-scanned antenna depending on the services, features and performance requirements.

A phase-array antenna, such as an electronically scanned array (ESA) or similar antenna may scan very quickly and can be manufactured in a relatively flat and conformal package. However, the electronics for such antennas are typically expensive and the phased-array beam performance degrades rapidly with increase of scan angle. A phased-array antenna is typically only useable up to about 60 degrees scanned from the antenna's boresight. At present time, ESAs are not suitable for applications in high-frequency (Ka band or above) and wide-banded (one octave or more) communications because of technical immaturity and high cost.

A mechanically-scanned antenna may be inexpensive and provide consistent antenna beam performance independent of scan angle. However, mechanically-scanned antennas typically have relatively low scan speeds and high profiles that can result in wind loading and drag. Various types of mechanical scanning antennas in use today may utilize a Luneburg Lens Array (LLA) or a gimbaled, flat-plate antenna. The LLA is an array of four hemispherical Luneburg lens on a ground plane. The effective antenna gain is for the full height of the LLA since the antenna aperture area is doubled by use of an image created by the ground plane. The flat-plate antenna may be similar to that used for terrestrial satellite TV, but the size of the effective aperture may only need to be about half for most aircraft applications. This is because most aircraft can fly above weather, where signal degradation due to rainfall attenuation is not a factor.

BRIEF SUMMARY OF THE INVENTION

In accordance with an embodiment of the present invention, a flap antenna may include a radio frequency (RF) feed and a shaped reflector formed in a selected shape to reflect electromagnetic radiation to or from the RF feed. The flap antenna may also include a flap reflector or the like to reflect the electromagnetic radiation to or from the shaped reflector. The flap reflector may be a flat plate.

In accordance with another embodiment of the present invention, a communications system may include a receiver, transceiver or the like. As used further herein, a transceiver may mean a device capable of both transmitting and receiving signals or only transmitting or only receiving signals. The system may also include a flap antenna coupled to the transceiver. The flap antenna may include a radio frequency (RF) feed and a shaped reflector formed in a selected shape to reflect electromagnetic radiation to or from the RF feed. The communications system may also include a flap reflector to reflect the electromagnetic radiation to or from the shaped reflector.

In accordance with another embodiment of the present invention, a method to scan an RF beam may include transmitting or receiving the RF beam with an RF feed. The method may also include reflecting the RF beam between a shaped reflector and a flap reflector. The shaped reflector may be formed in a selected shape to reflect the RF beam from the RF feed to the flap reflector in response to transmitting the RF beam and to reflect the RF beam to the RF feed from the flap reflector in response to receiving the RF beam. The method may further include pivoting the flap reflector for elevation scanning.

In accordance with another embodiment of the present invention, a method to substantially increase the gain and aperture of a flap antenna may include disposing a first flap reflector relative to a second flap reflector to substantially double the gain and aperture of the flap antenna. The method may also include polarizing the first flap reflector to reflect electromagnetic radiation oriented in one polarization and to transmit electromagnetic radiation oriented in another polarization to be reflected by the second flap reflector.

Other aspects and features of the present invention, as defined solely by the claims, will become apparent to those ordinarily skilled in the art upon review of the following non-limited detailed description of the invention in conjunction with the accompanying figures.

DETAILED DESCRIPTION OF THE INVENTION

The following detailed description of embodiments refers to the accompanying drawings, which illustrate specific embodiments of the invention. Other embodiments having different structures and operations do not depart from the scope of the present invention.

Figure 1A:
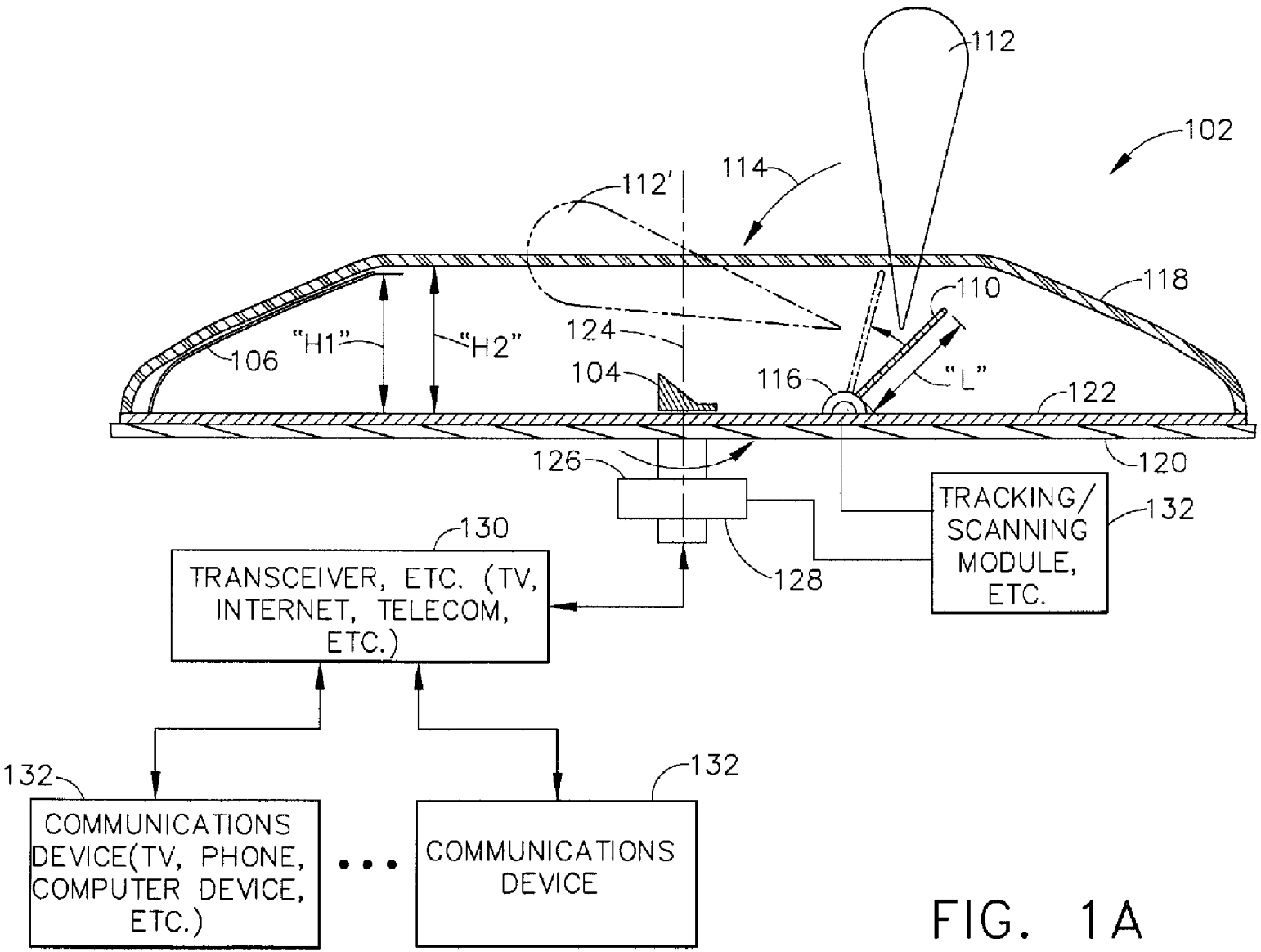
FIG. 1A is a block diagram of an example of a communications system and a side elevation view of a flap antenna in accordance with an embodiment of the present invention.

FIG. 1A is block diagram of an example of a communications system 100 and a side elevation view of a flap antenna 102 in accordance with an embodiment of the present invention. The antenna 102 may include a radio frequency (RF) feed 104. The RF feed 104 may include a horn antenna or the like formed to emit electromagnetic rays or an electromagnetic beam of a spherical wave.

Figure 1B:
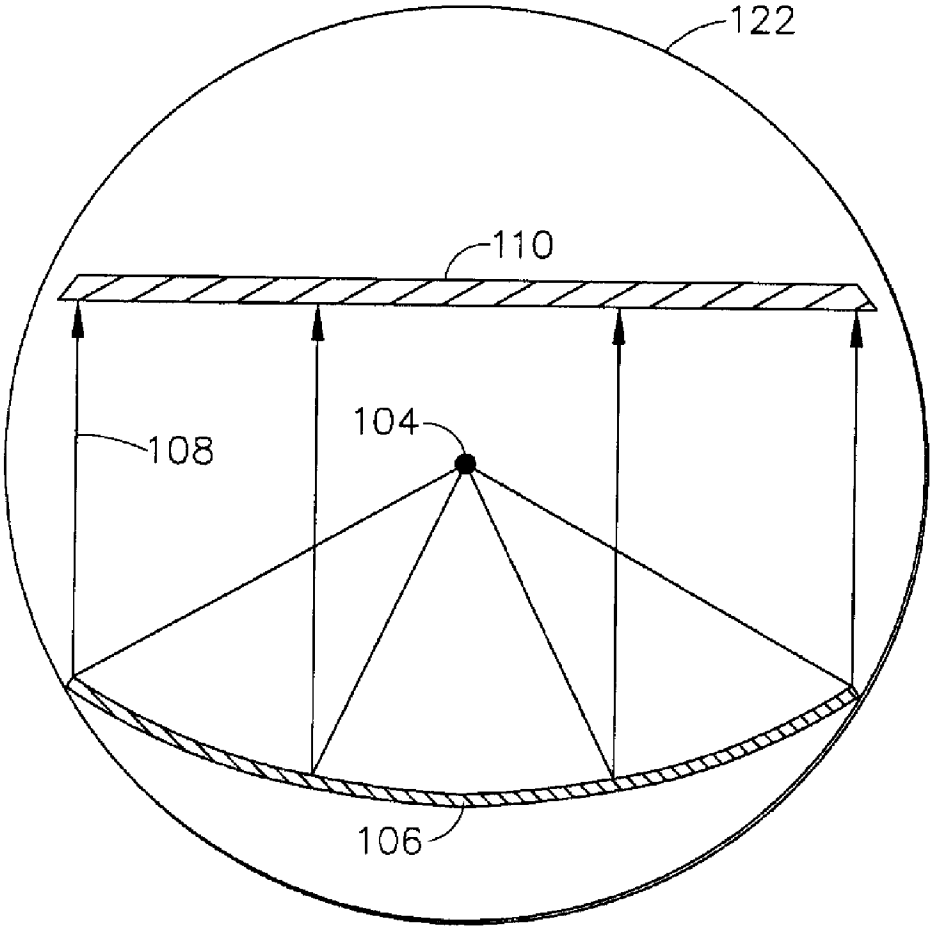
FIG. 1B is a top elevation view of the flap antenna of FIG. 1A.

The antenna 102 may also include a shaped reflector 106 formed in a selected shape to reflect electromagnetic radiation to or from the RF feed 104. The shaped reflector 106 may include a substantially parabolic form to reflect the spherical wave from the horn antenna 104 in collimated rays 108 to a flap reflector 110 as illustrated in FIG. 1B. FIG. 1B is a top elevation view of the flap antenna 102 of FIG. 1A. The flap reflector 110 may be pivotable to reflect or receive electromagnetic radiation or an electromagnetic beam 112 at a selected elevation or scan angle illustrated by the arrow 114 in FIG. 1A. A mechanism 116 may be provided to pivot the flap reflector 110 to the selected elevation 114 or to scan the antenna 102 or beam 112 in elevation as illustrated in FIG. 1A (beam 112 and 112'). The mechanism 116 may include an electrically operated motor and gear box or the like or a mechanical arrangement similar to that currently used to mechanically scan antennas.

The RF feed 104, shaped reflector 106, and flap reflector 110 may be disposed in an aerodynamically shaped radome 118 to reduce wind loading and drag when the antenna 102 is deployed on a mobile platform 120 and to protect the components of the antenna 102. Examples of the mobile platform 120 may include an aerospace vehicle, terrestrial vehicle, watercraft or the like. The flap reflector 110 may be a predetermined length "L," the shaped reflector 106 may have a predetermined height "H1," and the radome 118 may be a predetermined height "H2," to define as low a profile as possible dependent upon operational parameters, such as frequency and bandwidth, to substantially reduce wind loading and drag when the antenna 102 is deployed on the mobile platform 120.

The flap antenna 102 may be mounted on a rotatable ground plane 122 for azimuth scanning. As illustrated in FIG. 1B, the rotatable ground plane 122 may be substantially circular and may be rotated about a pivot point or axis 124 as illustrated in FIG. 1A. The RF feed 104 may be positioned proximate to the pivot point or axis 124 or may be off center from the axis 124 similar to that illustrated in the embodiments of the present invention shown in FIGS. 2 and 3A. A mechanism 126 may be provided to rotate the ground plane 122. The mechanism 126 may include an electric motor and a gear box or the like, or a mechanical arrangement similar to that currently used to mechanically scan antennas. A rotary joint 128 or the like may be used to couple the RF feed 104 to maintain an RF connection to other components of the system 100, such as a transceiver 130 or the like.

A module 132 may be coupled to the flap reflector pivot mechanism 116 and the ground plane rotation mechanism 126 to control elevation and azimuth scanning and tracking. The module 132 may be a microprocessor programmed to control scanning and other operations of the flap antenna 102 or other logic or software on a computer associated with the communications system 100. Accordingly, the present invention is capable of scanning a 360 degree azimuth and a substantially 0 degrees to 90 degrees elevation except where the beam 112 may be blocked by the shaped reflector 106 in some embodiments of the present invention.

As previously discussed, the system 100 may include a transceiver 130, receiver, or the like, depending upon the purpose of the communications system 100. The transceiver 130 or receiver may be for purposes of receiving television signals (for example, DirecTV or the like), transmitting and receiving signals related to communications over the Internet or other network, such as Boeing's Connexion system or the like, radio (XM Radio or the like), telecommunications or other communications purposes. Connexion by Boeing is a trademark of Boeing Management Company in the United States, other countries or both. The transceiver 130 may be coupled to a plurality of communications devices 132, such as TV monitors or displays, computer devices, phones or other communications devices, or to jacks or plugs into which any of these communications devices 132 may be connected for communications.

Figure 2:
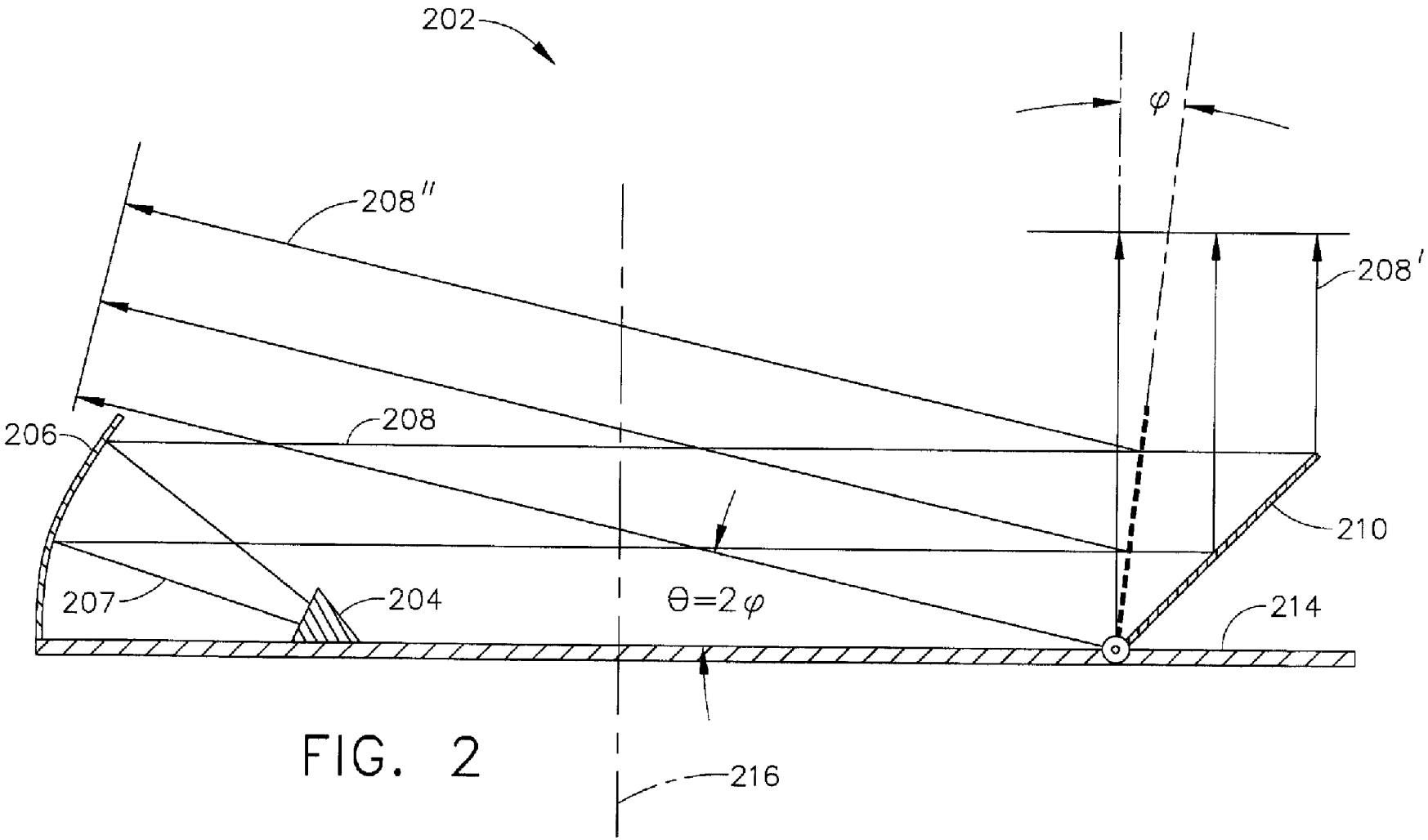
FIG. 2 is a side elevation view of a flap antenna in accordance with another embodiment of the present invention.

FIG. 2 is a side elevation view of a flap antenna 202 in accordance with another embodiment of the present invention. The flap antenna 202 may also be used with a communications system or may form a component of a communications system similar to the communications system 100 in FIG. 1A or the like. The antenna 202 may include an RF feed 204 and a shaped reflector 206. The RF feed 204 may be a horn antenna for emitting electromagnetic radiation or rays as a spherical wave or other polarization similar to the RF feed 104 of the flap antenna 102 of FIG. 1A. The spherical wave or electromagnetic rays or radiation is illustrated by lines 207 in FIG. 2. The shaped reflector 206 may be substantially a parabolic shaped reflector similar to the shaped reflector 106 of FIG. 1A to reflect the spherical wave 207 from the horn antenna or RF feed 204 as collimated rays illustrated by lines 208 in FIG. 2. The collimated rays 208 are directed by the shaped or parabolic reflector 206 to a flap reflector 210. The flap reflector 210 may be similar to the flap reflector 110 in FIG. 1A. The flap reflector 210 may be pivotable to scan the flap antenna 202 in elevation. As illustrated in FIG. 2, the elevation scan angle $\theta$ may range from about the zenith or substantially perpendicular from a ground plane 214 of the antenna 202 (as illustrated by rays 208') to an angle toward the horizon that may be set by the height of the shaped reflector 206 (as illustrated by rays 208"). As further illustrated in FIG. 2, the elevation scan angle $\theta$ may correspond to about twice the tilt angle $\phi$ of the flap reflector 210.

The RF feed 204 may be off-center from the axis 216 of rotation of the ground plane 214. Similar to the ground plane 122 of antenna 102 in FIG. 1A, the ground plane 214 may be rotatable to provide substantially 360 degrees of azimuth scanning. The RF feed 204 may be coupled to a rotary joint (not shown in FIG. 2) similar to rotary joint 128 (FIG. 1A) or other arrangements may be provided to maintain the RF connection between the antenna 202 and any communications equipment to which the antenna 202 may be coupled. The antenna 202 may also include an aerodynamically designed radome to minimize wind loading and drag and to protect the antenna 202. The radome may be similar to the radome 118 in FIG. 1A and is therefore not shown in FIG. 2.

Figure 3A:
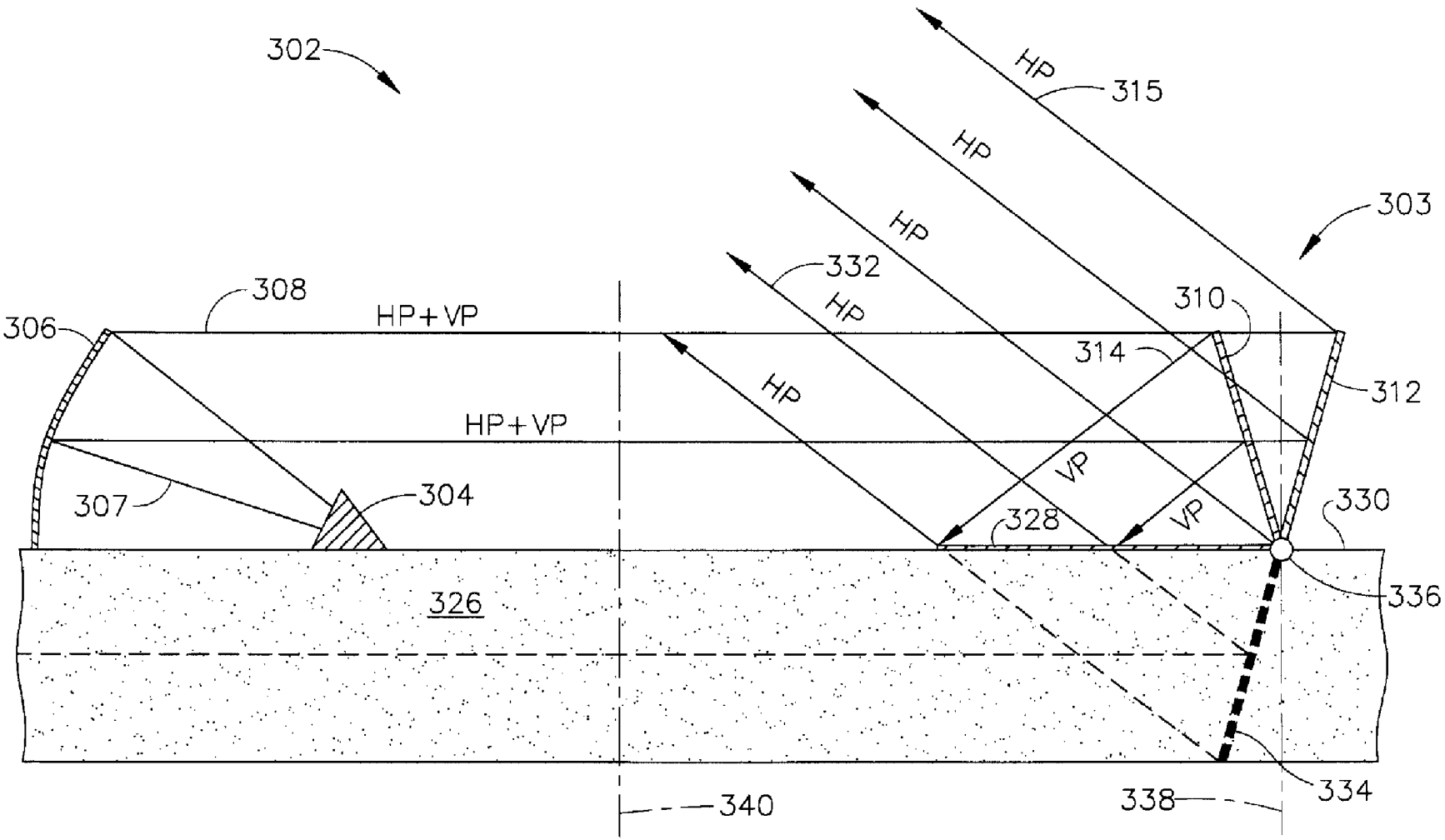
FIG. 3A is a side elevation view of a dual flap antenna in accordance with a further embodiment of the present invention.

FIG. 3A is a side elevation view of a dual flap antenna 302 in accordance with a further embodiment of the present invention. In applications where linear polarization may be permitted, the antenna gain of the dual flap antenna 302 may be substantially doubled compared to the previously described antenna architectures by providing linearly polarized dual flap reflectors 303 as described in more detail below. The dual flap antenna 302 may also be used with a communications system similar to communications system 100 in FIG. 1A or the like. Similar to the flap antenna 102 in FIG. 1A, the dual flap antenna 302 may include an RF feed 304 and a shaped reflector 306. The RF feed 304 may be a dual polarized horn antenna for emitting electromagnetic radiation or rays, as illustrated by lines 307, in both horizontal and vertical polarizations. The shaped reflector 306 may be a substantially parabolic reflector to reflect the rays 307 as collimated horizontal and vertical polarized (HP+VP) rays 308.

As previously discussed, in applications where linear polarization may be used, the gain of the antenna 302 may be substantially doubled by providing dual flap reflectors 303 or a first flap reflector 310 and a second flap reflector 312. This may result in effectively doubling an aperture area of the antenna as described in more detail below. The second flap reflector 312 may be disposed behind the first flap reflector 310 and aligned therewith to substantially double the antenna gain as further described. The first flap reflector 310 may be polarized to reflect either vertically polarized or horizontally polarized electromagnetic radiation and to substantially pass or transmit the other polarization through to the second flap reflector 312. The second flap reflector 312 may then reflect the other or opposite polarization passed by the first flap reflector 312 or may reflect any electromagnetic radiation incident upon it. In the example illustrated in FIG. 3A, the first flap reflector 310 may be polarized to reflect electromagnetic radiation 314 that is vertically polarized and to transmit horizontally polarized electromagnetic radiation to the second flap reflector 312. The second flap reflector 312 may reflect the horizontally polarized electromagnetic radiation 315 or any polarization of electromagnetic radiation transmitted by the first flap reflector 310. The second flap reflector 312 may be a metal plate, such as aluminum or other conductive material.

Figure 3B:
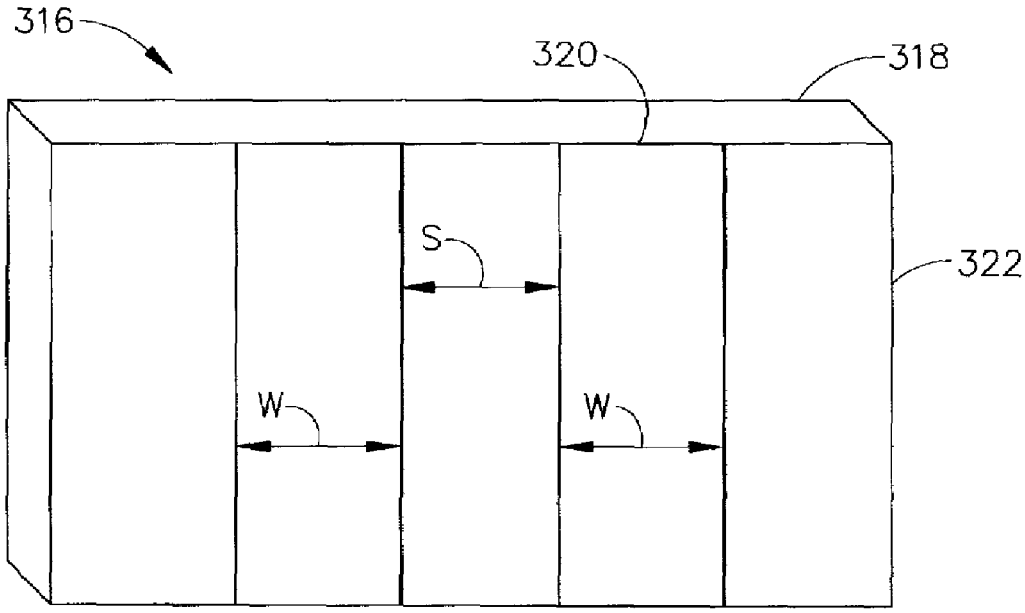
FIG. 3B is an example of a polarized surface of a flap reflector for use with the dual flap antenna of FIG. 3A.

In one embodiment of the present invention, the first flap reflector 310 may be a half-wavelength (½λ) fiber glass material or the like, such as a G10-plate with a metal grid 316 similar to that illustrated in FIG. 3B. FIG. 3B is an example of a polarized surface 318 of a flap reflector that may be used for the first flap reflector 310 in the dual flap antenna 302 of FIG. 3A. The metal grid 316 may include vertical metalized or conductive strips 320 disposed on a dielectric substrate 322 or the like to reflect the vertically polarized (VP) electromagnetic radiation or rays incident on the first flap reflector 310 and to substantially pass or transmit the horizontally polarized (HP) electromagnetic radiation or rays. The conductive strips 320 may have a predetermined width "W" and may be spaced by a selected spacing "S" as illustrated in FIG. 3B. The width and spacing may be a function of the frequency and wavelength of the electromagnetic radiation expected to be reflected and transmitted by the flap reflector. In another embodiment of the present invention, the metal grid 316 for use with the first flap reflector 310 could be disposed horizontally to substantially reflect horizontally polarized electromagnetic radiation and to substantially transmit vertically polarized electromagnetic radiation.

Referring back to FIG. 3A, the electromagnetic radiation or rays polarized to be reflected by the first flap reflector 310 (vertically polarized (VP) rays 314 in the example illustrated in FIG. 3A) may be reflected toward a ground plane 326. A polarization rotator 328 may be formed or disposed in a surface 330 of the ground plane 326. The polarization rotator 328 may substantially rotate and reflect the electromagnetic radiation 314 in a polarization corresponding to the other polarization of the electromagnetic radiation 315 reflected by the second flap reflector 312, as illustrated by reflected rays 332. In the example illustrated in FIG. 3A, the electromagnetic radiation or rays 332 reflected by the polarization rotator may be horizontally polarized the same as the electromagnetic radiation or rays 315 reflected by the second flap reflector 312. In effect, the second flap reflector 312 may appear electromagnetically to be extended or doubled in length, as illustrated by the broken or dashed line 334, and accordingly, the aperture area of the antenna 302 is effectively doubled, as is the antenna gain.

For elevation scanning, the first flap reflector 310 and the second flap reflector 312 may be pivotable about a common flap reflector pivot point 336. The first flap reflector 310 and the second flap reflector 312 may also be pivotable symmetrically relative to one another in a direction either toward or away from one another. The first flap reflector 310 and the second flap reflector 312 may also be pivotable symmetrically toward or away from a line 338 through the common pivot point 336 that is substantially perpendicular to the surface 330 of the ground plane 326.

For azimuth scanning, the ground plane 326 may be rotatable about an axis 340 for substantially 360 degree azimuth scanning. The ground plane 326 may be rotated using a mechanism similar to mechanism 126 described with respect to FIG. 1A.

Figure 4:
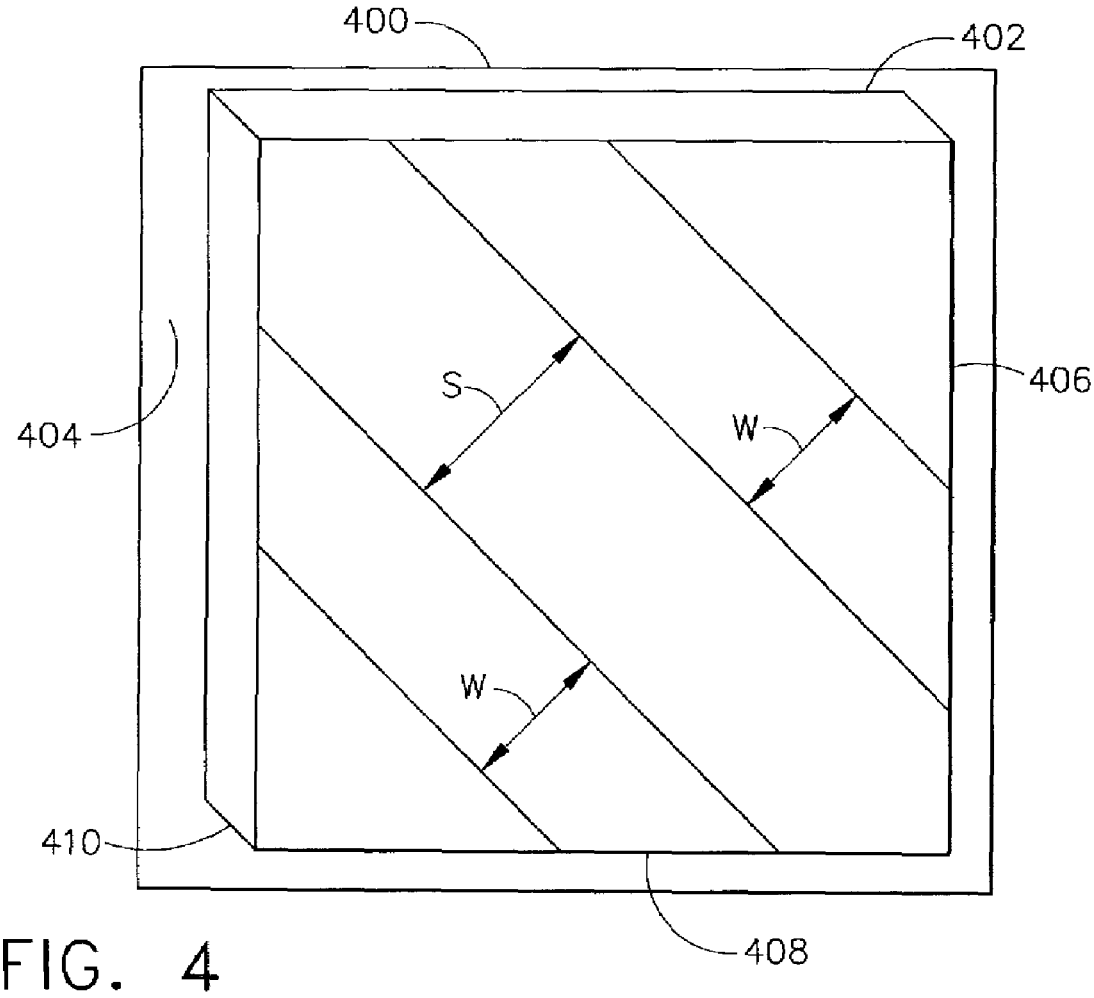
FIG. 4 is an example of a ground plane including a polarization rotator for use with a dual flap antenna in accordance with an embodiment of the present invention.

FIG. 4 is an example of a ground plane 400 including a polarization rotator 402 formed on a surface 404 of the ground plane 400 for use with a dual flap antenna, such as the dual flap antenna 302 of FIG. 3A. The ground plane 400 may be used for the ground plane 326 or ground plane portion in FIG. 3A and the polarization rotator 402 may be used for the polarization rotator 328 in FIG. 3A. As an example, the polarization rotator 402 may include a quarter wavelength (¼λ) G10-plate with a 45 degree grid 406 or the like. The grid 406 may include metalized or conductive strips 408 disposed diagonally on a substrate 410. The substrate 410 may be a dielectric. The conductive strips 408 may have a predetermined width "W" and may be spaced at a selected spacing "S." The width "W" and spacing "S" may be a function of the frequency and wavelength of the electromagnetic radiation or rays to be rotated and reflected by the polarization reflector 406.

Figure 5:
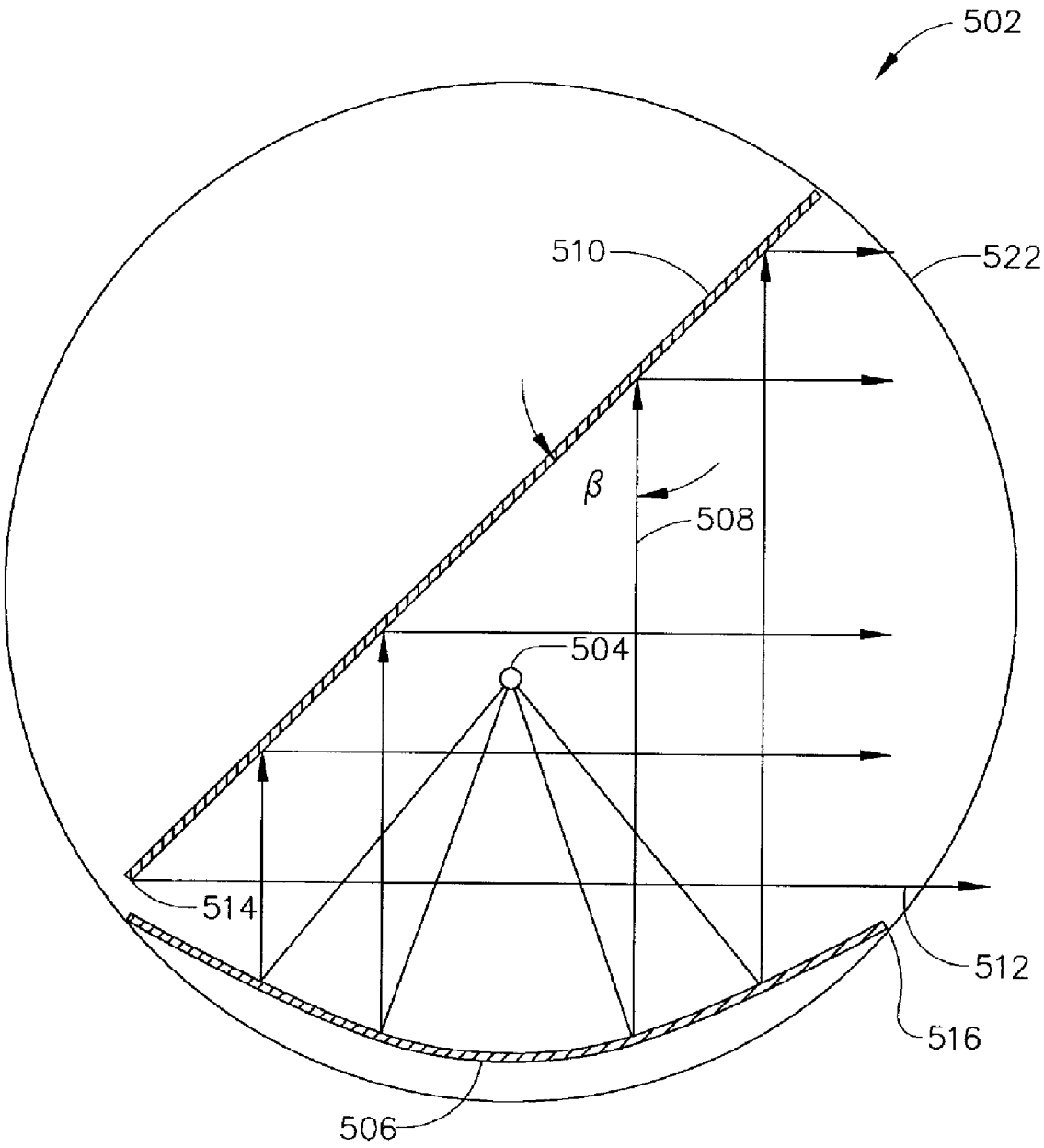
FIG. 5 is a top elevation view of a flap antenna in accordance with another embodiment of the present invention.

FIG. 5 is a top elevation view of a flap antenna 502 in accordance with another embodiment of the present invention. The flap antenna 502 may be similar to the flap antennas previously described with respect to FIGS. 1A, 1B, 2 and 3A including an RF feed 504, a shaped or parabolic reflector 506 and a flap reflector 510 or dual flap deflector as in the embodiment of FIG. 3A. In the exemplary embodiment illustrated in FIG. 5, the flap antenna 502 may include a flap reflector 510 or dual flap reflector (not shown in FIG. 5) that is positionable on the ground plane 522 to substantially avoid blockage of the electromagnetic radiation by the shaped reflector 506. Thus the flap antenna 502 is capable of elevation scanning between about 0 degrees or ground plane elevation and about 90 degrees or substantially perpendicular to the ground plane 522. As illustrated in FIG. 5, the flap reflector 510 may be rotated a predetermined angle β relative to a angle of incidence of the electromagnetic radiation or rays 508 reflected from the shaped or parabolic reflector 506. In the example illustrated in FIG. 5, the angle β may be about 45 degrees. However, the angle β and the positioning of the flap reflector 510 on the ground plane 522 may be coordinated such that any electromagnetic radiation or rays 512 reflected from an edge 514 of the reflector flap 510 closest to the shaped reflector 506 will miss an edge 516 of the shaped or parabolic reflector 506.

Similar to that previously described, with respect to the other embodiments of the present invention, the flap antenna 502 may be a component of or used with a communications system, such as the communications system 100 described with respect to FIG. 1A or another type of communications system.

Those skilled in the art will recognize that the flap antenna of the present invention is a simple and low-cost option for mobile satellite communication links. Some applicable platforms for the invention may include airplanes, helicopters, unmanned aerial vehicles (UAVs), and various terrestrial vehicles and watercraft or vessels. The flap antenna of the present invention may be used for communications systems, radar systems or similar systems associated with such platforms. The flap antenna may be formed to handle high power at any linear polarization (LP) and also right-hand circular polarization (RHCP), with the ability to instantly switch to left-hand circular polarization and vice versa. A single flap antenna can simultaneously handle transmission and reception (Tx/Rx) of signals at two different frequencies without incurring beam pointing errors between the Rx/Tx beams. The antenna is inherently wide-banded and capable of providing more than one octave in bandwidth. The antenna beam does not suffer from beam degradation, side lobe level degradation, grating lobe problems, or axial ratio deterioration as the beam is scannable off boresight. At least one embodiment of the invention is capable of providing substantially double the antenna gain without increasing the height of the antenna. Another embodiment of the invention may substantially scan the beam from horizon to zenith without blockage.

Additionally, the flap antenna of the present invention may be quite suitable for high-frequency applications. For satellite communications applications at 20 GHz and above, the antenna dimensions are estimated to be less than about 20-inches in diameter and about 6-inches in height, not including the radome dimensions. Commercially available feed horns indicate that a wide bandwidth of about 20 to about 60 GHz or wider may be possible.

The terminology used herein is for the purpose of describing particular embodiments only, and is not intended to be limiting of the invention. As used herein, the singular forms "a", "an" and "the" are intended to include the plural forms as well, unless the context clearly indicates otherwise. It will be further understood that the terms "comprises" and/or "comprising," and "includes" and/or "including" when used in this specification, specify the presence of stated features, integers, steps, operations, elements, and/or components, but do not preclude the presence or addition of one or more other features, integers, steps, operations, elements, components, and/or groups thereof.

Although specific embodiments have been illustrated and described herein, those of ordinary skill in the art appreciate that any arrangement which is calculated to achieve the same purpose may be substituted for the specific embodiments shown and that the invention has other applications in other environments. This application is intended to cover any adaptations or variations of the present invention. The following claims are in no way intended to limit the scope of the invention to the specific embodiments described herein.

What is claimed is:

1. A flap antenna, comprising:

a radio frequency (RF) feed;

a shaped reflector formed in a selected shape to reflect electromagnetic radiation directly to or from the RF feed;

a pivotable flap reflector to reflect the electromagnetic radiation to or from the shaped reflector and open space; and a ground plane, wherein the flap antenna is mounted to the ground plane with only the pivotable flap reflector being pivotably mounted to the ground plane and wherein the flap reflector is pivotable to reflect and receive the electromagnetic radiation at a selected elevation.

2. The flap antenna of claim 1, wherein the RF feed comprises a horn antenna formed to emit electromagnetic rays of a spherical wave.

3. The flap antenna of claim 2, wherein the shaped reflector comprises a substantially parabolic form to reflect the spherical wave from the horn antenna, in collimated rays, to the flap reflector.

4. The flap antenna of claim 1, further comprising a mechanism to pivot the flap reflector to the selected elevation and to scan in elevation.

5. The flap antenna of claim 1, wherein the flap reflector has a predetermined length and the shaped reflector a predetermined height to define a profile to substantially reduce drag when the flap antenna is mounted to a mobile platform.

6. The flap antenna of claim 1, wherein the ground plane comprises a rotatable ground plane on which the flap antenna is mounted for azimuth scanning.

7. The flap antenna of claim 6, wherein the RF feed is positioned proximate to a pivot point of the rotatable ground plane.

8. The flap antenna of claim 7, further comprising a rotary joint coupled to the RF feed to maintain a radio frequency connection when the rotatable ground plane is rotated about the pivot point.

9. The flap antenna of claim 6, wherein the RF feed is positioned off center from the pivot point of the rotatable ground plane.

10. The flap antenna of claim 1, wherein the flap reflector is positioned on a ground plane to avoid blockage by the shaped reflector and to permit scanning between about 0° and about 90° in elevation.

11. The flap antenna of claim 1, further comprising an aerodynamically shaped radome to substantially cover the RF feed, shaped reflector and flap reflector.

12. A flap antenna comprising:

a radio frequency (RF) feed;

a shaped reflector formed in a selected shape to reflect electromagnetic radiation to or from the RF feed; and a flap reflector to reflect the electromagnetic radiation to or from the shaped reflector, wherein the flap reflector comprises a first flap reflector and wherein the flap antenna further comprises a second flap reflector disposed relative to the first flap reflector to substantially double the gain and aperture of the flap antenna, wherein the first flap reflector is polarized to reflect the electromagnetic radiation oriented in one polarization and to transmit electromagnetic radiation in another polarization to be reflected by the second flap reflector.

13. The flap antenna of claim 12, wherein the second flap reflector is disposed behind the first flap reflector relative to the shaped reflector, and the first flap reflector and the second flap reflector are pivotable about a common flap reflector pivot point.

14. The flap antenna of claim 13, wherein the first flap reflector and the second flap reflector are pivotable symmetrically, relative to one another in a direction either toward or away from one another.

15. The flap antenna of claim 14, further comprising:

a ground plane;

a polarization rotator formed on a surface of the ground plane to substantially reflect the electromagnetic radiation reflected from the first flap reflector in a polarization corresponding to the other polarization of the electromagnetic radiation reflected by the second flap reflector.

16. The flap antenna of claim 15, wherein the first and second flap reflectors are positionable on the ground plane to avoid blockage by the shaped reflector and to permit scanning between about 0° and about 90° in elevation.

17. A communications system, comprising:

a transceiver; and a flap antenna coupled to the transceiver, wherein the flap antenna includes:

a radio frequency (RF) feed;

a shaped reflector formed in a selected shape to reflect electromagnetic radiation directly to or from the RF feed; and a pivotable flap reflector to reflect the electromagnetic radiation to or from the shaped reflector and open space; and a ground plane, wherein the flap antenna is mounted to the ground plane with only the pivotable flap reflector being pivotably mounted to the ground plane and wherein the flap reflector is pivotable to reflect and receive the electromagnetic radiation at a selected elevation.

18. The communications system of claim 17, further comprising a mechanism to pivot the flap reflector to reflect and receive the electromagnetic radiation at the selected elevation and for elevation scanning.

19. The communications system of claim 17, wherein the ground plane comprises:

a rotatable ground plane on which the flap antenna is mounted; and a mechanism to rotate the rotatable ground plane for azimuth scanning and to reflect and receive the electromagnetic radiation at a selected azimuth.

20. The communications system of claim 17, further comprising:

a mechanism to pivot the flap reflector to reflect and receive the electromagnetic radiation at a selected elevation and for elevation scanning;

a rotatable ground plane on which the flap antenna is mounted;

a mechanism to rotate the rotatable ground plane for azimuth scanning and to reflect and receive the electromagnetic radiation at a selected azimuth; and a module to control elevation and azimuth scanning and tracking.

21. The communications system of claim 17, wherein the flap reflector and the shaped reflector comprise a structure to define a profile to substantially reduce drag when the communications system is used on a mobile platform.

22. The communications system of claim 17, wherein the flap reflector is positioned on a ground plane to avoid blockage by the shaped reflector and to permit scanning between about 0° and about 90° in elevation.

23. The communications system of claim 17, wherein the electromagnetic radiation includes signals in a group comprising at least one of televisions signals, telecommunications signals and signals for Internet communications.

24. A communications system comprising:

a transceiver; and a flap antenna coupled to the transceiver, wherein the flap antenna includes:

a radio frequency (RF) feed;

a shaped reflector formed in a selected shape to reflect electromagnetic radiation to or from the RF feed; and a flap reflector to reflect the electromagnetic radiation to or from the shaped reflector, wherein the flap reflector comprises a first flap reflector and the communications system further comprises a second flap reflector disposed relative to the first flap reflector to substantially double the gain and aperture of the flap antenna, wherein the first flap reflector is linearly polarized to reflect the electromagnetic radiation in one of a vertical polarization or a horizontal polarization and to transmit electromagnetic radiation in another one of the vertical polarization or horizontal polarization to be reflected by the second flap reflector.

25. The communications system of claim 24, wherein the second flap reflector is disposed behind the first flap reflector relative to the shaped reflector, and the first flap reflector and the second flap reflector are pivotable about a common flap reflector pivot point.

26. The communications system of claim 25, further comprising:

a ground plane;

a polarization rotator formed in a surface of the ground plane to substantially reflect the electromagnetic radiation reflected from the first flap reflector in a polarization corresponding to the polarization of the electromagnetic radiation reflected by the second flap reflector.

27. A method to scan an RF beam, comprising:

transmitting or receiving the RF beam by an RF feed;

reflecting the RF beam between a shaped reflector and a pivotable flap reflector, wherein the shaped reflector is formed in a selected shape to reflect the RF beam received directly from the RF feed to the flap reflector in response to transmitting the RF beam and to reflect the RF beam directly to the RF feed from the flap reflector in response to the flap reflector receiving the RF beam from open space; and pivoting the pivotable flap reflector for elevation scanning, wherein the shaped reflector and the pivotable flap reflector are both mounted to a ground plane with only the pivotable flap reflector being pivotably mounted to the ground plane and wherein only the flap reflector is pivotable for elevation scanning.

28. The method of claim 27, further comprising rotating the ground plane for azimuth scanning, wherein the RF feed, the shaped reflector and the flap reflector are mounted on the ground plane.

29. The method of claim 27, further comprising positioning the flap reflector relative to the shaped reflector to avoid blockage by the shaped reflector and to permit scanning between about 0° and about 90° in elevation.

30. The method of claim 27, further comprising transforming a spherical wave from a horn antenna into collimated rays from the shaped reflector to the flap reflector.

31. A method to scan an RF beam, comprising:

transmitting or receiving the RF beam by an RF feed;

reflecting the RF beam between a shaped reflector and a flap reflector, wherein the shaped reflector is formed in a selected shape to reflect the RF beam from the RF feed to the flap reflector in response to transmitting the RF beam and to reflect the RF beam directly to the RF feed from the flap reflector in response to receiving the RF beam;

pivoting the flap reflector for elevation scanning;

constituting the flap reflector as a first flap reflector; and pivoting a second flap reflector relative to the first flap reflector to substantially increase the gain and aperture of the RF beam, wherein the second flap reflector is disposed behind the first flap reflector relative to the shaped reflector and wherein the first flap reflector is polarized to reflect electromagnetic radiation oriented in one polarization and to transmit electromagnetic radiation oriented in another polarization for reflection by the second flap reflector.

32. The method of claim 31, further comprising pivoting the first flap reflector and the second flap reflector symmetrically relative to one another in a direction either toward or away from one another.

33. The method of claim 31, further comprising reflecting the electromagnetic radiation incident on a ground plane from the first flap reflector in a polarization corresponding to the polarization of the electromagnetic radiation reflected by the second flap reflector.

34. The method of claim 31, further comprising positioning the first and second flap reflections relative to the shaped reflector to avoid blockage by the shaped reflector and to permit scanning between about 0° and about 90° in elevation.

35. A method to substantially increase the gain and aperture of a flap antenna, comprising:

disposing a first flap reflector relative to a second flap reflector to substantially double the gain and aperture of the flap antenna, wherein disposing the first flap reflector relative to the second flap reflector comprises disposing the second flap reflector behind the first flap reflector relative to a shaped reflector, the first flap reflector and the second flap reflector being pivotable about a common flap reflector pivot point; and polarizing the first flap reflector to reflect electromagnetic radiation oriented in one polarization and to transmit electromagnetic radiation oriented in another polarization to be reflected by the second flap reflector.

36. The method of claim 35, further comprising pivoting the first flap reflector and the second flap reflector symmetrically relative to one another in a direction either toward or away from one another.

37. The method of claim 35, further comprising polarizing a surface of a ground plane to substantially reflect the electromagnetic radiation reflected from the first flap reflector in a polarization corresponding to the other polarization of the electromagnetic radiation reflected by the second flap reflector.

38. The method of claim 35, further comprising positioning the first and second flap reflectors on a ground plane to avoid blockage by a shaped reflector and to permit scanning between about 0° and about 90° in elevation.

* * * * *

UNITED STATES PATENT AND TRADEMARK OFFICE

CERTIFICATE OF CORRECTION

PATENT NO. : 7,605,770 B2
APPLICATION NO. : 11/306169
DATED : October 20, 2009
INVENTOR(S) : Kim et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 394 days.

Signed and Sealed this

Fifth Day of October, 2010

David J. Kappos

David J. Kappos
*Director of the United States Patent and Trademark Office*